US011421883B2

(12) United States Patent
Binek et al.

(10) Patent No.: US 11,421,883 B2
(45) Date of Patent: Aug. 23, 2022

(54) FUEL INJECTOR ASSEMBLY WITH A HELICAL SWIRLER PASSAGE FOR A TURBINE ENGINE

(71) Applicant: Raytheon Technologies Corporation, Farmington, CT (US)

(72) Inventors: Lawrence A. Binek, Glastonbury, CT (US); Timothy S. Snyder, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/019,009

(22) Filed: Sep. 11, 2020

(65) Prior Publication Data

US 2022/0082257 A1 Mar. 17, 2022

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 1,460,470 A 7/1923 Joseph
2,046,592 A * 7/1936 Tracy ..... B05B 7/12 239/402
2,385,833 A 10/1945 Nahigyan
2,616,258 A 11/1952 Mock
2,727,358 A 12/1955 Howes
3,053,461 A 9/1962 Inglis
3,153,323 A 10/1964 Hamm
3,430,443 A 3/1969 Richardson
3,603,711 A 9/1971 Downs
3,693,354 A 9/1972 Hull, Jr.
3,693,889 A 9/1972 Schuster
3,777,983 A 12/1973 Hibbins
3,886,736 A 6/1975 Kawaguchi
3,904,119 A * 9/1975 Watkins ..... B05B 7/10 239/405
3,915,137 A 10/1975 Evans
3,915,387 A * 10/1975 Caruel ..... F23R 3/14 239/400
3,937,007 A 2/1976 Kappler
(Continued)

FOREIGN PATENT DOCUMENTS

CN 205560737 U 9/2016
CN 206055626 U 3/2017
(Continued)

OTHER PUBLICATIONS

GB search report for GB2113229.5 dated Mar. 7, 2022.

*Primary Examiner* — William H Rodriguez
(74) *Attorney, Agent, or Firm* — Getz Balich LLC

(57) ABSTRACT

An apparatus is provided for a turbine engine. This turbine engine apparatus includes a fuel nozzle. The fuel nozzle includes an airflow inlet, a nozzle orifice, a fuel passage and a swirler passage. The fuel passage is fluidly coupled with the swirler passage through a first fuel aperture in a wall between the fuel passage and the swirler passage. The swirler passage extends along a helical trajectory away from the airflow inlet and towards the nozzle orifice.

18 Claims, 10 Drawing Sheets

(56) References Cited

U.S. PATENT DOCUMENTS

| | | | | |
|---|---|---|---|---|
| 4,028,044 | A | 6/1977 | Carlisle | |
| 4,081,958 | A | 4/1978 | Schelp | |
| 4,134,260 | A | 1/1979 | Lefebvre | |
| 4,242,863 | A | 1/1981 | Bailey | |
| 4,271,675 | A * | 6/1981 | Jones | F23R 3/14 60/737 |
| 4,295,821 | A | 10/1981 | Schilling | |
| 4,305,255 | A | 12/1981 | Davies | |
| 5,129,226 | A | 7/1992 | Bigelow | |
| 5,133,192 | A | 7/1992 | Overton | |
| 5,423,178 | A | 6/1995 | Mains | |
| 5,568,721 | A | 10/1996 | Alary | |
| 5,822,992 | A * | 10/1998 | Dean | F23R 3/286 60/737 |
| 5,836,163 | A | 11/1998 | Lockyer | |
| 5,873,237 | A | 2/1999 | Medla | |
| 6,438,961 | B2 | 8/2002 | Tuthill | |
| 6,460,344 | B1 | 10/2002 | Steinthorsson | |
| 6,490,864 | B1 | 12/2002 | Joos | |
| 6,672,066 | B2 | 1/2004 | Wrubel | |
| 6,931,862 | B2 | 8/2005 | Harris | |
| 7,870,736 | B2 | 1/2011 | Homitz | |
| 7,891,191 | B2 | 2/2011 | Yoshida | |
| 7,954,328 | B2 | 6/2011 | Atassi | |
| 9,062,609 | B2 | 6/2015 | Mehring | |
| 9,217,373 | B2 * | 12/2015 | Boardman | F02C 7/24 |
| 9,383,145 | B2 | 7/2016 | Weber | |
| 9,803,498 | B2 | 10/2017 | Jewess | |
| 9,939,155 | B2 * | 4/2018 | Pfeffer | F23D 11/103 |
| 10,570,865 | B2 | 2/2020 | Zhang | |
| 10,619,855 | B2 | 4/2020 | Brogan | |
| 10,739,005 | B2 | 8/2020 | Kironn | |
| 2002/0069645 | A1 | 6/2002 | Mowill | |
| 2006/0213180 | A1 | 9/2006 | Koshoffer | |
| 2007/0044476 | A1 | 3/2007 | Koshoffer | |
| 2008/0201008 | A1 | 8/2008 | Twelves, Jr. | |
| 2009/0020266 | A1 | 1/2009 | Weber | |
| 2009/0255264 | A1 | 10/2009 | McMasters | |
| 2009/0260365 | A1 | 10/2009 | Muldoon | |
| 2010/0050653 | A1 | 3/2010 | Lam | |
| 2010/0205971 | A1 * | 8/2010 | Williams | F23R 3/14 60/748 |
| 2010/0263381 | A1 * | 10/2010 | Ishizaka | F23R 3/14 60/737 |
| 2010/0281871 | A1 | 11/2010 | Hadley | |
| 2011/0005232 | A1 * | 1/2011 | Williams | F23C 7/004 60/748 |
| 2011/0289928 | A1 | 12/2011 | Fox | |
| 2011/0296839 | A1 | 12/2011 | Van Nieuwenhuizen | |
| 2013/0098048 | A1 | 4/2013 | Popovic | |
| 2013/0104554 | A1 * | 5/2013 | Bode | F23D 11/38 60/740 |
| 2015/0253010 | A1 * | 9/2015 | Schlein | F23L 7/002 60/776 |
| 2016/0209041 | A1 | 7/2016 | Twelves, Jr. | |
| 2017/0082288 | A1 * | 3/2017 | Ryon | F23R 3/28 |

FOREIGN PATENT DOCUMENTS

| | | | |
|---|---|---|---|
| CN | 107420892 | A | 12/2017 |
| CN | 110594792 | A | 12/2019 |

* cited by examiner

FUEL INJECTOR ASSEMBLY WITH A HELICAL SWIRLER PASSAGE FOR A TURBINE ENGINE

BACKGROUND OF THE DISCLOSURE

1. Technical Field

This disclosure relates generally to a turbine engine and, more particularly, to a fuel injector for the turbine engine.

2. Background Information

A combustor section in a modern a turbine engine includes one or more fuel injectors. Each fuel injector is operable to inject fuel for combustion within a combustion chamber. Various types and configurations of fuel injectors are known in the art. While these known fuel injectors have various benefits, there is still room in the art for improvement. There is a need in the art, for example, for fuel injectors with reduced manufacturing costs, that facilitate reduced assembly time as well as that reduce likelihood of carbon buildup within the combustion chamber caused by solidification of and/or traces of non-combusted fuel.

SUMMARY OF THE DISCLOSURE

According to an aspect of the present disclosure, an apparatus is provided for a turbine engine. This turbine engine apparatus includes a fuel nozzle. The fuel nozzle includes an airflow inlet, a nozzle orifice, a fuel passage and a swirler passage. The fuel passage is fluidly coupled with the swirler passage through a first fuel aperture in a wall between the fuel passage and the swirler passage. The swirler passage extends along a helical trajectory away from the airflow inlet and towards the nozzle orifice.

According to another aspect of the present disclosure, another apparatus is provided for a turbine engine. This turbine engine apparatus includes a fuel nozzle. The fuel nozzle includes a nozzle orifice, an inner body, an outer body and a helical shroud. The inner body is configured with a fuel passage. The outer body is configured with an airflow inlet. The helical shroud extends longitudinally along and wraps circumferentially about the inner body. The helical shroud forms a swirler passage between the inner body and the outer body. An upstream portion of the swirler passage is fluidly coupled with the airflow inlet and the fuel passage. A downstream portion of the swirler passage is fluidly coupled with the nozzle orifice.

According to still another aspect of the present disclosure, another apparatus is provided for a turbine engine. This turbine engine apparatus includes a fuel nozzle. The fuel nozzle includes an airflow inlet, a nozzle orifice, a fuel passage and a mixing passage. The fuel passage extends longitudinally along a longitudinal centerline. The fuel passage is fluidly coupled with the mixing passage through a plurality of fuel apertures in a wall between the fuel passage and the mixing passage. A first of the fuel apertures is longitudinally offset from a second of the fuel apertures along the longitudinal centerline. The fuel nozzle is configured to mix air received from the airflow inlet with fuel received from each of the fuel apertures within the mixing passage to provide an air-fuel mixture for expelling out of the fuel nozzle through the nozzle orifice.

The mixing passage is configured as or otherwise includes a swirler passage that follows a helical trajectory away from the airflow inlet and towards the nozzle orifice.

The swirler passage may be configured to mix and swirl (a) air received from the airflow inlet with at least (b) fuel received from the first fuel aperture to provide a swirled air-fuel mixture to the nozzle orifice.

The swirler passage may extend along the helical trajectory at least one full revolution around a longitudinal centerline.

The helical trajectory may extend circumferentially about a longitudinal centerline. The first fuel aperture may be configured to direct fuel from the fuel passage into the swirler passage along a canted trajectory that is angularly offset from the longitudinal centerline by an acute angle.

The fuel passage may also be fluidly coupled to the swirler passage through a second fuel aperture in the wall between the fuel passage and the swirler passage.

The second fuel aperture may be circumferentially offset from the first fuel aperture about a centerline of the fuel passage.

The second fuel aperture may be longitudinally offset from the first fuel aperture along a longitudinal centerline of the fuel passage.

The fuel nozzle may also include an inner body, an outer body and a helical shroud. The inner body may be configured with the fuel passage. The inner body may include the wall between the fuel passage and the swirler passage. The helical shroud may form the swirler passage between the inner body and the outer body.

The helical shroud may be connected to and/or may extend radially between the inner body and the outer body.

The swirler passage may extend along the helical trajectory to the nozzle orifice.

The turbine engine apparatus may also include a scoop fluidly coupled with and configured to provide air to the airflow inlet.

The turbine engine apparatus may also include a bleed passage fluidly coupled with and configured to provide air to the airflow inlet.

The turbine engine apparatus may also include a fuel vaporizer. The fuel nozzle may be configured to direct a swirled air-fuel mixture out from the nozzle orifice and against the fuel vaporizer.

The turbine engine apparatus may also include an air tube that includes an air passage. The fuel nozzle may be configured to direct a swirled air-fuel mixture out from the nozzle orifice and into the air passage to impinge against an inner sidewall surface of the air tube.

The turbine engine apparatus may also include a combustor wall at least partially forming a combustion chamber. The air tube may be connected to the combustor wall and project into the combustion chamber.

The turbine engine apparatus may also include a turbine engine case. At least the fuel nozzle and the turbine engine case may be formed together in a monolithic body.

The turbine engine apparatus may also include a second fuel nozzle and a fuel conduit. The second fuel nozzle may include a second airflow inlet, a second nozzle orifice, a second fuel passage and a second swirler passage. The second fuel passage may be fluidly coupled to the second swirler passage through a second fuel aperture in a wall between the second fuel passage and the second swirler passage. The second swirler passage may extend along a second helical trajectory away from the second airflow inlet and towards the second nozzle orifice. The fuel conduit may be configured to provide fuel to the fuel passage and the second fuel passage.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
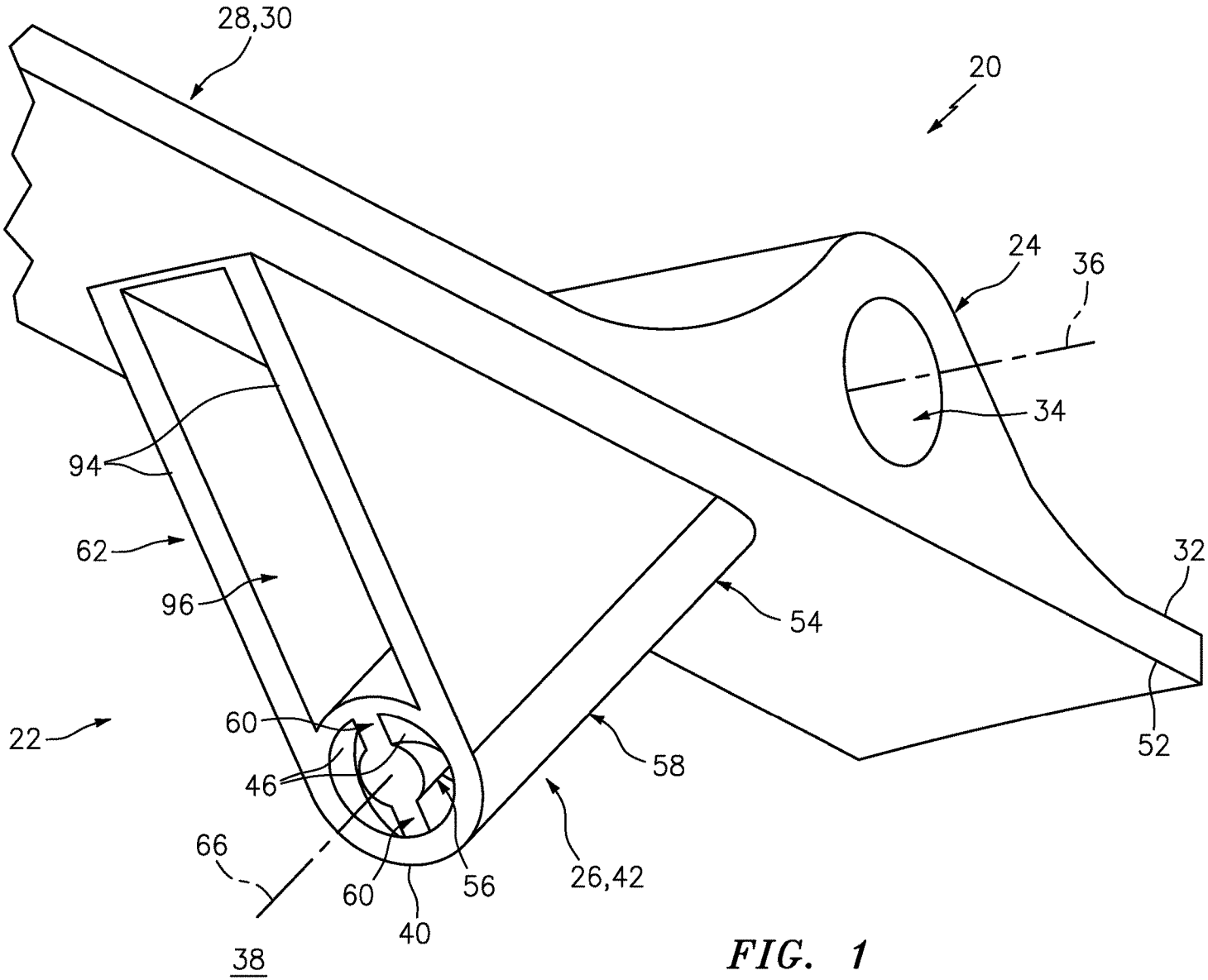
FIG. 1 is a perspective illustration of a portion of a fuel injector assembly for a turbine engine.

FIG. 1 illustrates a portion of an apparatus 20 for a turbine engine. This turbine engine apparatus 20 is configured as, or otherwise includes, a fuel injector assembly 22 for a combustor section of the turbine engine. The turbine engine apparatus 20 includes a fuel conduit 24 and a fuel nozzle 26. The turbine engine apparatus 20 of FIG. 1 may also include an apparatus base 28, which apparatus base 28 may provide a structural support for the fuel conduit 24 and/or the fuel nozzle 26.

The apparatus base 28 may be configured as any part of the turbine engine within the combustor section that is proximate the fuel injector assembly 22. The apparatus base 28 of FIG. 1, for example, may be configured as a turbine engine case 30 such as, but not limited to, a combustor section case, a diffuser case and/or a combustor wall.

The fuel conduit 24 is configured as, or may be part of, a fuel supply for the fuel nozzle 26. The fuel conduit 24, for example, may be or may be part of a fuel supply tube, a fuel inlet manifold and/or a fuel distribution manifold. The fuel conduit 24 is arranged at and/or is connected to a first side 32 (e.g., an exterior and/or outer side) of the apparatus base 28. The fuel conduit 24 is configured with an internal fuel supply passage 34 formed by an internal aperture (e.g., a bore, channel, etc.) within the fuel conduit 24. The supply passage 34 and the associated aperture extend within and/or through the fuel conduit 24 along a (e.g., curved or straight) centerline 36 of the supply passage 34, which may also be a centerline of the fuel conduit 24.

Figure 2:
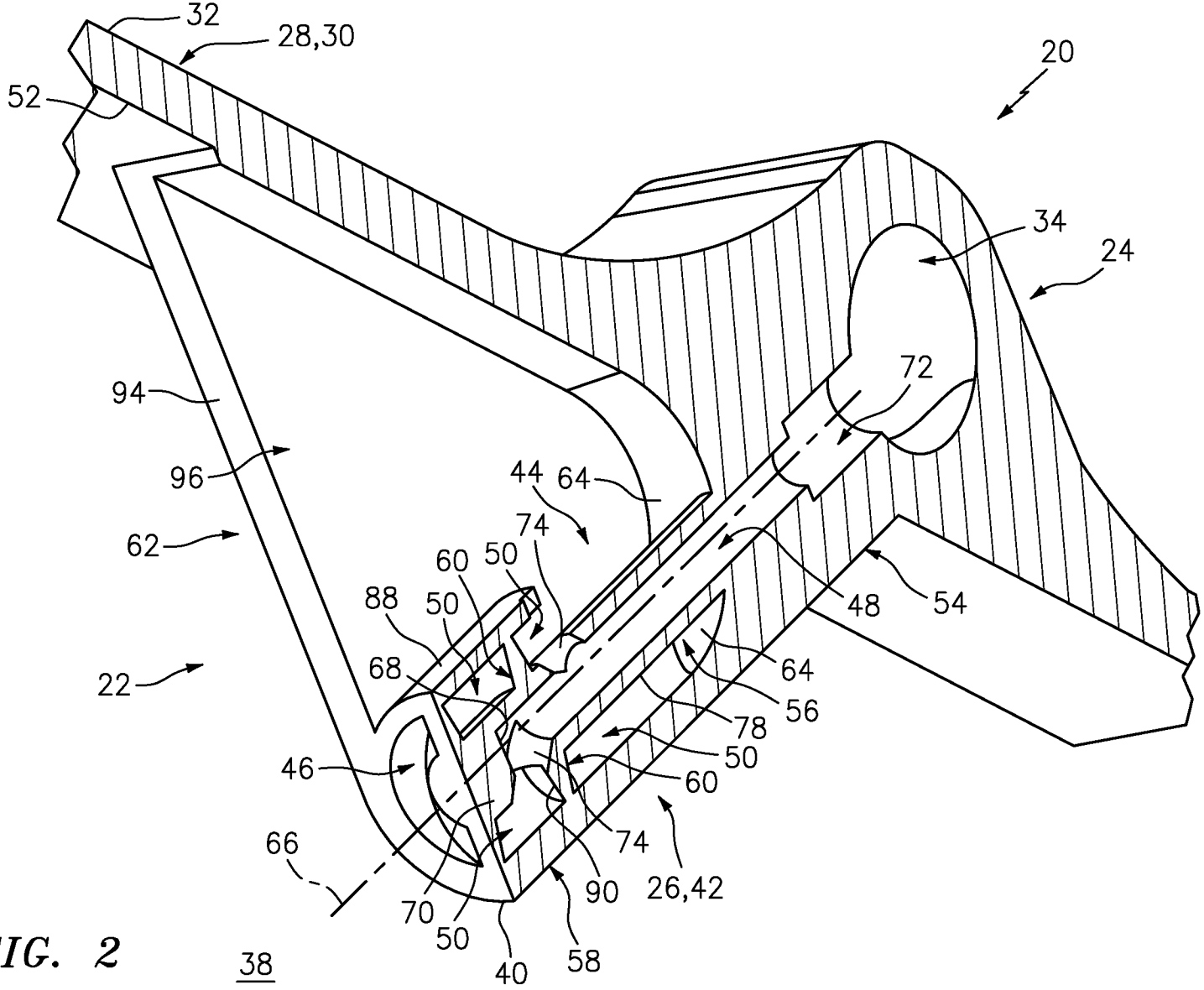
FIG. 2 is a perspective sectional illustration of another portion of the fuel injector assembly.

Referring to FIG. 2, the fuel nozzle 26 is configured to receive fuel from the fuel conduit 24, and inject the received fuel into a plenum 38 at a distal end 40 (e.g., tip) of the fuel nozzle 26. The fuel nozzle 26 of FIG. 2 includes a nozzle body 42 configured with an upstream airflow inlet 44, a downstream nozzle orifice 46 (e.g., a nozzle outlet), a fuel passage 48 and a swirler and/or mixing passage 50 (referred to below as "swirler passage" for ease of description).

The nozzle body 42 is arranged at and/or is connected to a second side 52 (e.g., an interior and/or inner side) of the apparatus base 28, where the base second side 52 is opposite the base first side 32. The nozzle body 42 of FIG. 2 includes a fuel nozzle base 54, a fuel nozzle inner body 56 (e.g., a center body), a fuel nozzle outer body 58 and a helical shroud 60 (e.g., a swirler element). The nozzle body 42 may also include a support structure 62.

The fuel nozzle base 54 is arranged at and/or is connected to the base second side 52. The fuel nozzle base 54 is configured to mount the inner body 56 and/or the outer body 58 to the apparatus base 28. The fuel nozzle base 54 may also provide a sloped end surface/turning surface 64 for a transition from the airflow inlet 44 to the swirler passage 50.

The inner body 56 may be configured as an at least partially (or completely) tubular member of the nozzle body 42. A base end of the inner body 56 is connected to the fuel nozzle base 54. The inner body 56 projects longitudinally out from the fuel nozzle base 54 along a longitudinal centerline 66 to (or towards) the fuel nozzle distal end 40. Of course, in other embodiments, the inner body 56 may project longitudinally out from the apparatus base 28 where, for example, the fuel nozzle base 54 is omitted and/or incorporated into the structure of the inner body 56 and/or the outer body 58.

An internal bore in the inner body 56 at least partially (or completely) forms the fuel passage 48. The fuel passage 48 of FIG. 2, for example, extends longitudinally into (or within) the inner body 56 along the longitudinal centerline 66 from the inner body base end to a distal fuel passage end 68. The fuel passage 48 may also extend out of (or through) the fuel nozzle base 54 before entering the inner body 56. The distal fuel passage end 68 may be defined by an integral endcap 70 of the inner body 56 at the fuel nozzle distal end 40. The distal fuel passage end 68 is thereby a blind end. An upstream end of the fuel passage 48 (e.g., within the fuel nozzle base 54) is fluidly coupled to the supply passage 34 by an aperture 72 (e.g., a counterbore) in the apparatus base 28 and/or in the fuel nozzle base 54. However, in other embodiments, the fuel passage 48 may also project into and/or otherwise be formed by the apparatus base 28 where, for example, the fuel passage 48 extends completely through the fuel nozzle base 54. The aperture 72, for example, may be omitted and the fuel passage 48 may be tied directly into (e.g., extend to) the supply passage 34.

Figure 3:
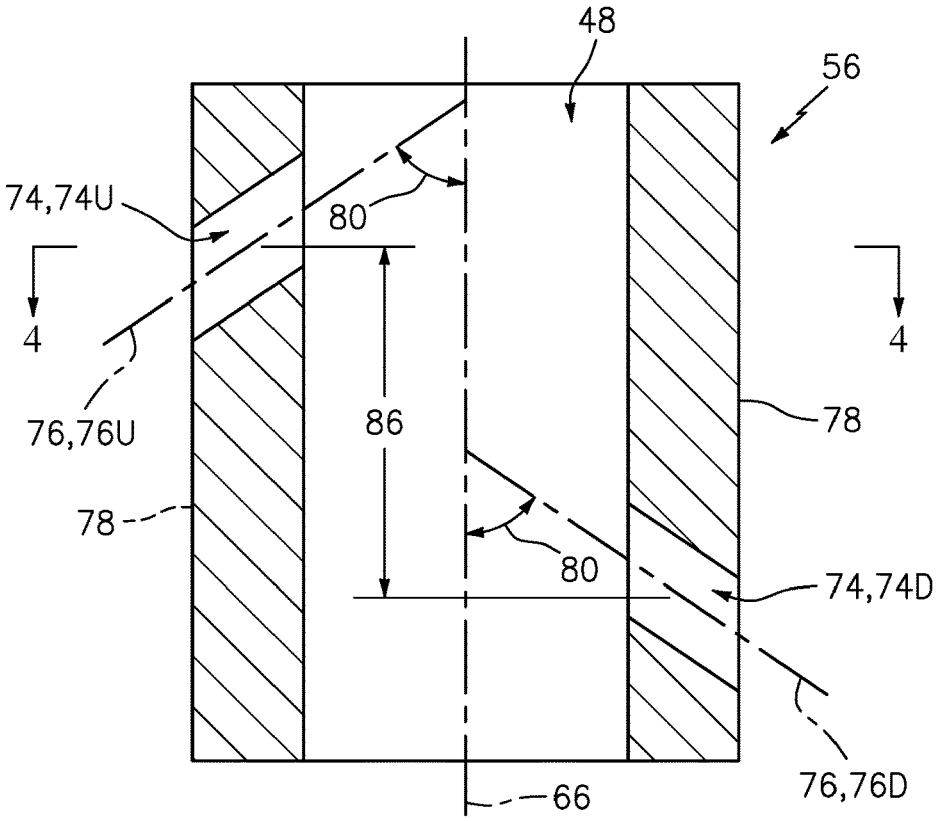
FIG. 3 is a side sectional illustration of a portion of a fuel injector inner body.
Figure 4:
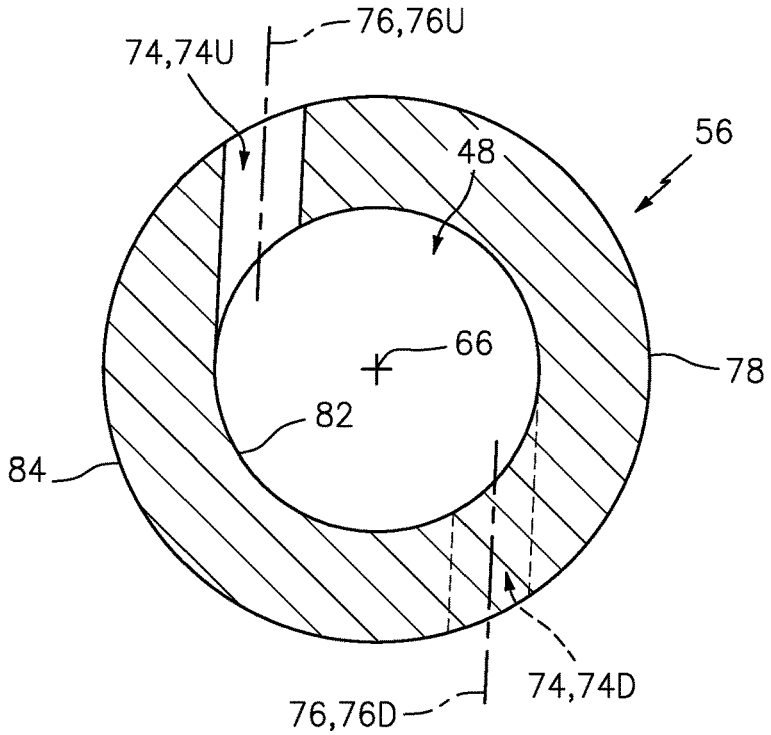
FIG. 4 is a cross-sectional illustration of a portion of the fuel injector inner body taken along line 4-4 in FIG. 3.

The inner body 56 also includes one or more fuel apertures 74. Each of these fuel apertures 74 is configured to fluidly couple the fuel passage 48 to the swirler passage 50. Each fuel aperture 74 of FIGS. 3 and 4, for example, extends along a respective fuel aperture centerline 76 through a wall 78 (e.g., a tubular sidewall) of the inner body 56. Referring to FIG. 3, the fuel aperture centerline 76 may be angularly offset from the longitudinal centerline 66 by an acute angle 80 when viewed, for example, in a plane parallel with and/or coincident with the longitudinal centerline 66; e.g., plane of FIG. 3. Referring to FIG. 4, the fuel aperture centerline 76 may also or alternatively be laterally offset and/or displaced from (e.g., non-coincident with) the longitudinal centerline 66 when viewed, for example, in a plane perpendicular to and/or coincident with the longitudinal centerline 66; e.g., plane of FIG. 4. Each fuel aperture 74 and its centerline 76, for example, may be canted so as to be generally tangential with an interior surface 82 (or an exterior surface 84) of the inner body wall 78. Each fuel aperture 74 may thereby be configured to direct fuel from the fuel passage 48 into the swirler passage 50 along a canted trajectory that is angularly and/or laterally offset from the longitudinal centerline 66.

Referring to FIG. 3, at least some or all of the fuel apertures 74 may be longitudinally offset from one another along the longitudinal centerline 66. A center of the upstream fuel aperture 74U and its centerline 76U, for example, are longitudinally displaced from a center of the downstream fuel aperture 74D and its centerline 76D by a longitudinal distance 86. Such longitudinal displacement(s) may provide fuel injected by the fuel nozzle 26 with different delay times. Briefly, the term "delay time" may refer to a period of time between the point of fuel injection (e.g., where fuel is introduced into the swirler passage 50) and burning of that air-fuel mixture downstream and outside of the fuel nozzle 26. In addition or alternatively, referring to FIG. 4, at least some or all of the fuel apertures 74 may be circumferentially offset from one another about the longitudinal centerline 66. The upstream fuel aperture 74U and its centerline 76U, for example, are circumferentially displaced from the downstream fuel aperture 74D and its centerline 76D by a circumferential distance and/or a non-zero angle about the longitudinal centerline 66. For example, the centerlines 76 (when viewed relative to the trajectories through the respective fuel apertures 74) may be angularly offset between ninety degrees (90°) and two-hundred and seventy degrees (270°); e.g., one-hundred and eighty degrees (180°). Of course, in other embodiments, the centerlines 76 may be angularly offset by an acute angle less than ninety degrees (90°) or an obtuse angle greater than two-hundred and seventy degrees (270°). In still other embodiments, the centerlines 76 may be circumferentially aligned; e.g., not angularly offset.

Figure 5:
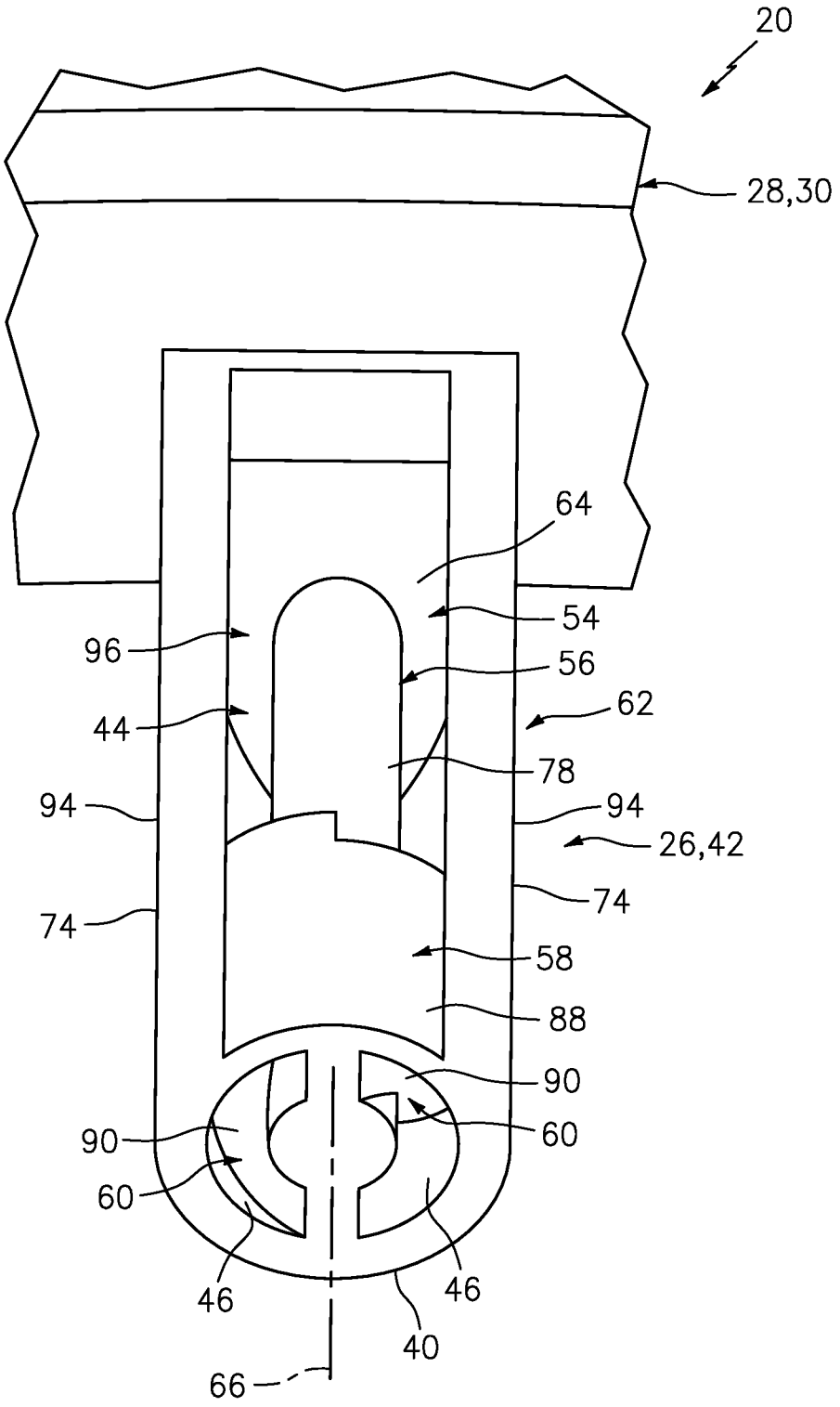
FIG. 5 is another perspective illustration of a portion of the fuel injector assembly.

Referring to FIGS. 2 and 5, the outer body 58 may be configured as an at least partially (or completely) tubular member of the nozzle body 42. A base end of the outer body 58 is connected to the fuel nozzle base 54. The outer body 58 projects longitudinally out from the fuel nozzle base 54 along the longitudinal centerline 66 to (or towards) the fuel nozzle distal end 40. Of course, in other embodiments, the outer body 58 may project longitudinally out from apparatus base 28 where, for example, the fuel nozzle base 54 is omitted and/or incorporated into the structure of the inner body 56 and/or the outer body 58.

A wall 88 (e.g., tubular sidewall) of the outer body 58 is laterally (e.g., radially) displaced from the inner body wall 78. The outer body wall 88 extends circumferentially about and longitudinally along the inner body wall 78 such that the outer body 58 may at least partially (or completely) circumscribe and at least partially (or completely) longitudinally overlap the inner body 56. The inner body 56 may thereby be arranged within/longitudinally project into an internal bore of the outer body 58.

The outer body 58 includes or partially forms the airflow inlet 44. In particular, the airflow inlet 44 of FIGS. 2 and 5 extends laterally (e.g., radially) through the outer body wall 88. The airflow inlet 44 is positioned longitudinally adjacent the fuel nozzle base 54 and its surface 64.

The outer body 58 and the inner body 56 may collectively form the nozzle orifice 46 at the nozzle distal end 40. The nozzle orifice 46 of FIGS. 2 and 5, for example, is formed by a (e.g., generally annular) gap laterally (e.g., radially) between the inner body 56 and the outer body 58. Of course, in other embodiments, the nozzle orifice 46 may be formed completely by the outer body 58 where, for example, the inner body 56 is recessed into the fuel nozzle 26 from the outer body 58 and the nozzle distal end 40.

Figure 6:
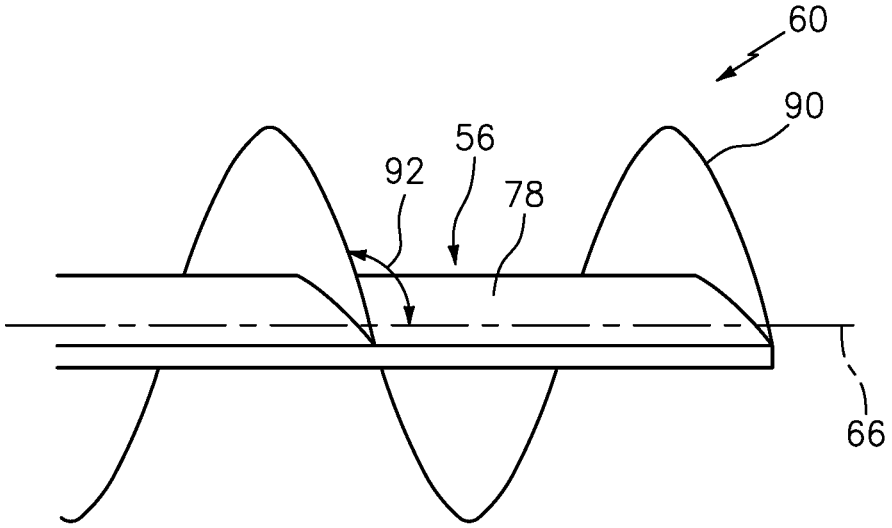
FIG. 6 is a schematic illustration of a portion of a single fighting member helical shroud wrapped around the fuel injector inner body.
Figure 7:
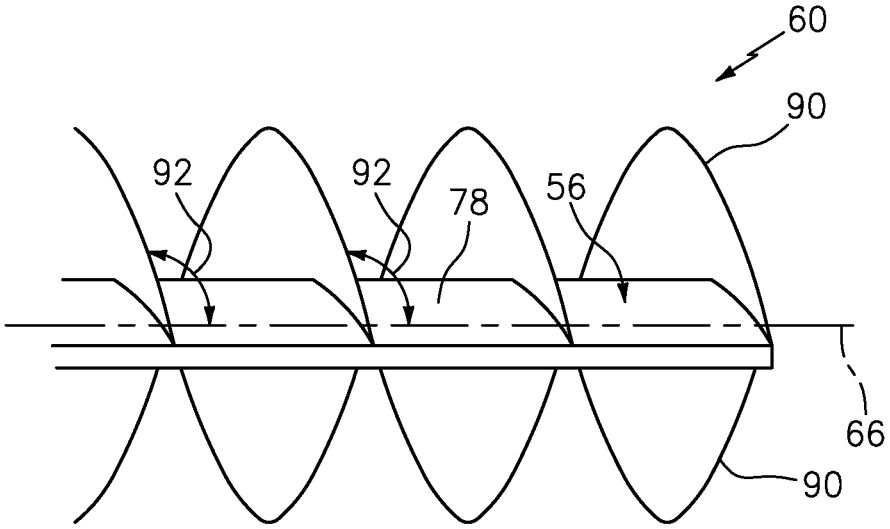
FIG. 7 is a schematic illustration of a portion of a double fighting member helical shroud wrapped around the fuel injector inner body.

Referring to FIGS. 6 and 7, the helical shroud 60 includes one or more helical fighting members 90 (schematically shown without apertures 74 in FIGS. 6 and 7). Each fighting member 90 extends longitudinally along and wraps circumferentially around the inner body 56. More particularly, each fighting member 90 follows a helical (e.g., spiral) trajectory. Each fighting member 90 may extend at least one-half of one full (e.g., complete) revolution around the inner body 56 and, thus, the longitudinal centerline 66. Each fighting member 90, for example, may extend between one and three full revolutions (between 360° and 1080°) around the inner body 56 and the longitudinal centerline 66. Of course, in other embodiments, one or more or each fighting member 90 may extend less than one full revolution (360°) around the inner body 56 and the longitudinal centerline 66. In still other embodiments, one or more or each fighting member 90 may extend more than three full revolutions (1080°) around the inner body 56 and the longitudinal centerline 66.

Each fighting member 90 may be angularly offset from the longitudinal centerline 66 by an acute angle 92. This acute angle 92 may be between thirty degrees (30°) and sixty degrees (60°); e.g., about forty-five degrees (45°). The present disclosure, however, is not limited to such exemplary embodiments.

Figure 8:
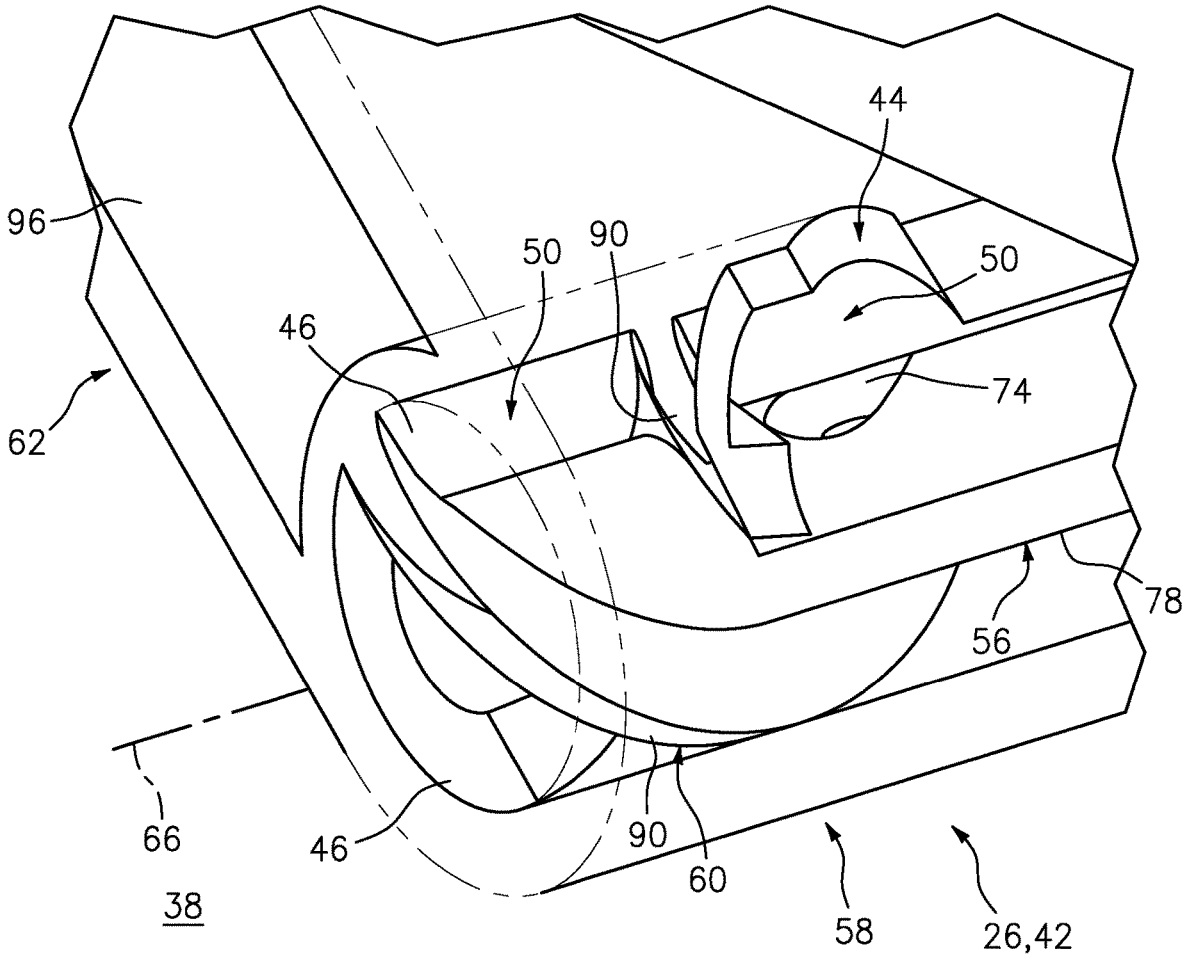
FIG. 8 is a perspective ghost view illustration of another portion of the fuel injector assembly.
Figure 9:
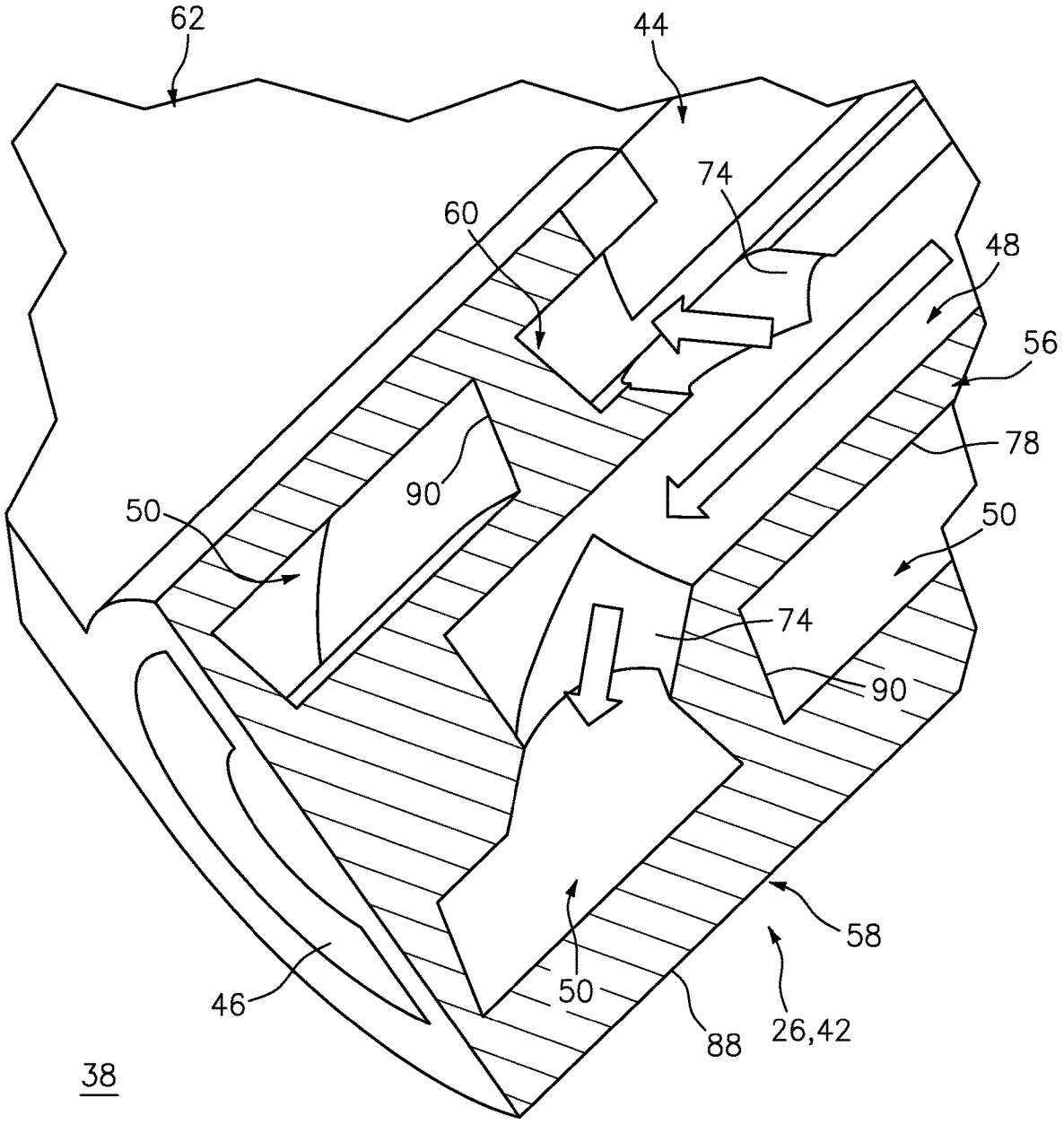
FIG. 9 is a perspective sectional illustration of another portion of the fuel injector assembly with fuel flowing along exemplary trajectories.

Referring to FIGS. 8 and 9, the helical shroud 60 and its fighting member(s) 90 are arranged and/or extend laterally (e.g., radially) between the inner body 56 and the outer body 58. The helical shroud 60 and its flighting member(s) 90 are connected to the inner body 56 and/or the outer body 58. The helical shroud 60 and its fighting member(s) 90 are longitudinally between the airflow inlet 44 and the nozzle orifice 46. The helical shroud 60 and its fighting member(s) 90 of FIGS. 8 and 9, for example, extend longitudinally from (or proximate) the airflow inlet 44 to (or towards) the nozzle orifice 46.

The helical shroud 60 and its fighting member(s) 90 form the swirler and/or mixing passage 50 as a helical passage. More particularly, the swirler passage 50 includes one or more channels, where each channel follows/extends along a helical trajectory (see also FIGS. 6 and 7) as that channel extends away from the airflow inlet 44 and towards (or to) the nozzle orifice 46. An upstream portion of the swirler passage 50 (and its channel(s)) is fluidly coupled with the airflow inlet 44 and one or more of the fuel apertures 74. A downstream portion of the swirler passage 50 (and its channel(s)) is fluidly coupled with (e.g., and directly adjacent) the nozzle orifice 46. With this configuration, once fuel is injected into the swirler passage 50 from the fuel passage 48 through the fuel apertures 74, the swirler passage 50 and its channel(s) are operable to further facilitate mixing of the fuel with the air and swirl that mixture to provide a swirled air-fuel mixture to the nozzle orifice 46.

Referring to FIGS. 2 and 5, the support structure 62 is configured to provide a support brace between the nozzle body 42 and the apparatus base 28. The support structure 62 of FIGS. 2 and 5, for example, forms one or more structural webs 94 between the nozzle body 42 and the apparatus base 28. The support structure 62 of FIGS. 2 and 5 is also configured to form an air scoop 96; e.g., a ram air scoop. This air scoop 96 is formed by and extends between the webs 94. The air scoop 96 is configured to direct a relatively large quantity of air into the airflow inlet 44 for subsequent mixing with fuel within the swirler passage 50. The present disclosure, however, is not limited to inclusion of the air scoop 96 as discussed below in further detail.

Still referring to FIGS. 2 and 5, during turbine engine operation, air (e.g., compressed air, diffuser plenum air, etc.) is directed by the air scoop 96 into the swirler passage 50 through the airflow inlet 44. As the air travels from the relatively large cross-sectional area air scoop 96 to the relatively small cross-sectional area swirler passage 50, the air velocity of the air increases. Referring now to FIGS. 8 and 9, once in the swirler passage 50, the air follows along a helical trajectory (see also FIGS. 6 and 7) as the air flows within the swirler passage 50 and its channel(s) towards the nozzle orifice 46. Each fuel aperture 74 directs a jet of fuel into the swirler passage 50, where the fuel mixes with the air within the swirler passage 50. The swirling of the air and the fuel within the swirler passage 50 further mixes the air and fuel as well as atomizes the fuel to provide a swirled air-fuel mixture for injection into the plenum 38 through the nozzle orifice 46.

Figure 10:
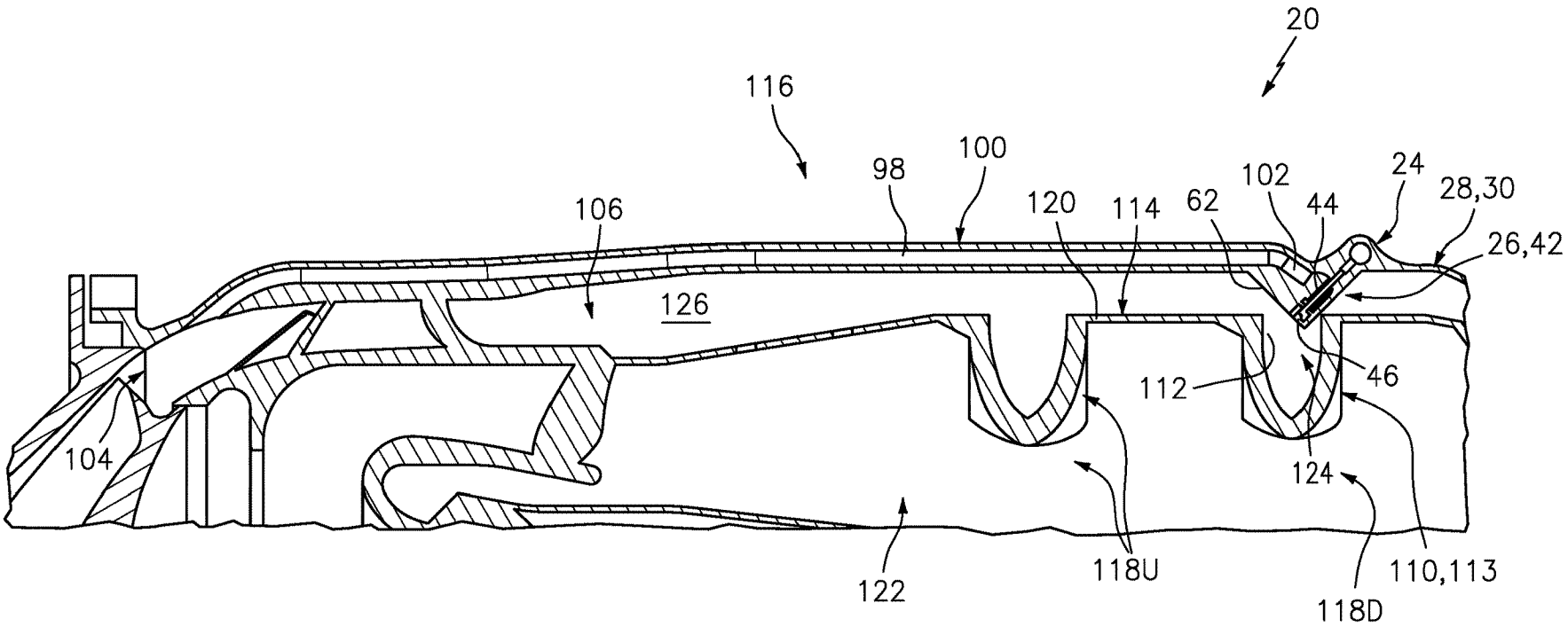
FIG. 10 is a partial side sectional illustration of a portion of a combustor section.

In some embodiments, referring to FIG. 10, the airflow inlet 44 may alternatively be fluidly coupled with and downstream of a bleed passage 98 formed by a bleed passage conduit 100. The support structure 62 of FIG. 10, for example, may be configured to provide a fluid coupling 102 (e.g., a passage) from the bleed passage 98 to the airflow inlet 44. The bleed passage 98 may be configured to bleed air (e.g., compressed air) off from a flowpath 104 (e.g., a core flowpath) prior to being diffused within a diffuser 106 such that the air provided to the airflow inlet 44 has a higher velocity for enhanced swirl within the swirler passage 50. In the specific embodiment of FIG. 10, the bleed passage 98 and its conduit 100 are formed as an integral portion of the apparatus base 28. The present disclosure, however, is not limited to such an exemplary configuration.

Figure 11:
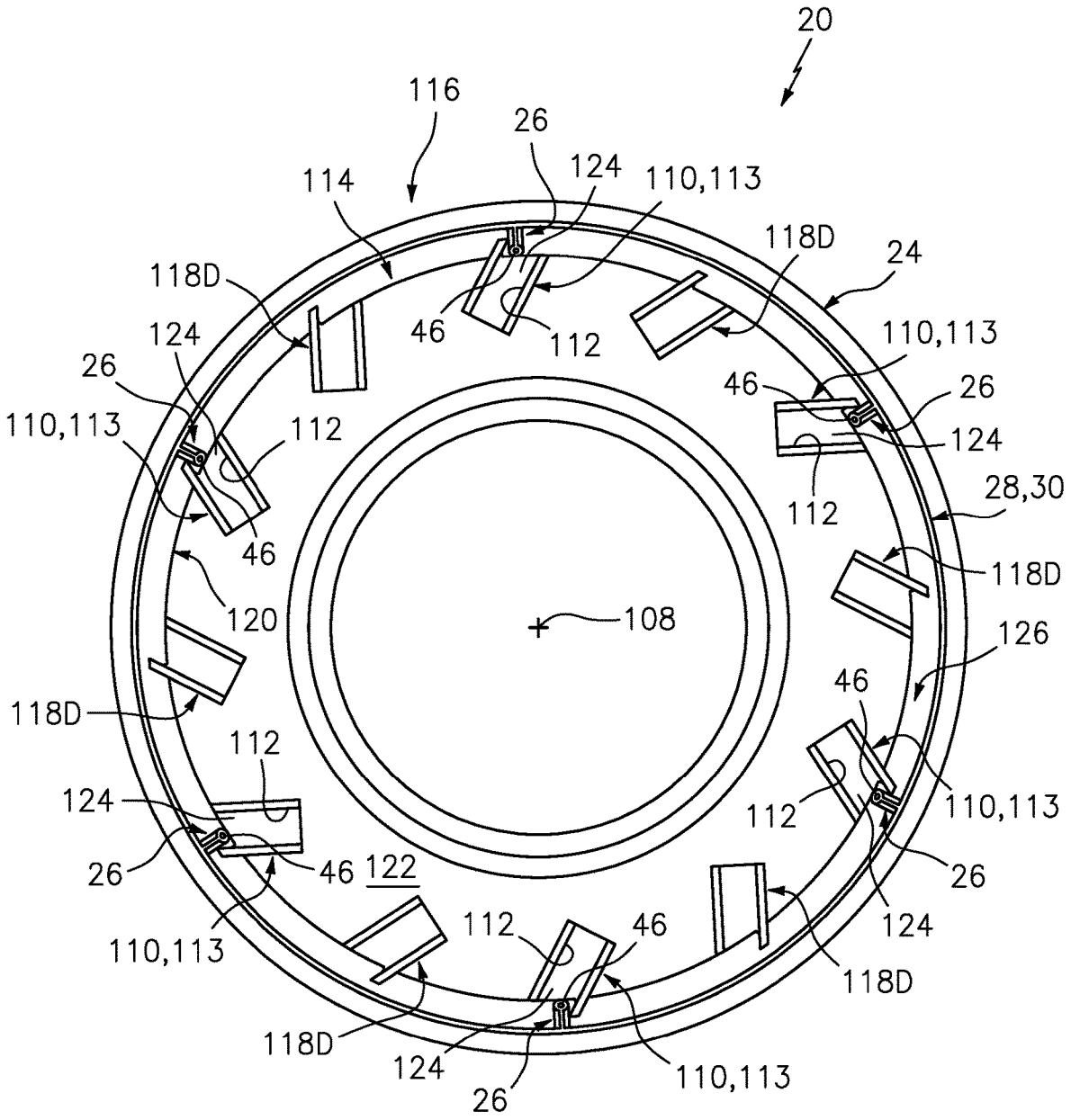
FIG. 11 is a cross-sectional illustration of the combustor section configured with a plurality of the fuel injector assemblies.

In some embodiments, referring to FIG. 11, the fuel nozzle 26 may be one of a plurality of fuel nozzles 26 connected to the apparatus base 28 and fluidly coupled with the fuel conduit 24. These fuel nozzles 26 may be arranged circumferentially about a centerline/rotational axis 108 of the turbine engine in an annular array.

In some embodiments, referring to FIGS. 1 and 11, the apparatus base 28, the fuel conduit 24 and each fuel nozzle 26 (as well as each bleed passage conduit 100 when included; see FIG. 10) may be configured together in a monolithic body. The present disclosure, however, is not limited to such an exemplary construction. For example, in other embodiments, one or more or each of the apparatus components 24, 26, 28 and/or 100 and/or portions thereof may be individually formed and subsequently connected (e.g., fastener and/or bonded) together.

In some embodiments, referring to FIGS. 10 and 11, the turbine engine apparatus 20 may also include one or more fuel vaporizers 110. Each fuel nozzle 26 is arranged with a respective one of the fuel vaporizers 110. Each fuel nozzle 26 is configured to direct fuel out of its nozzle orifice 46 to impinge a surface 112 of the respective fuel vaporizer 110. The fuel vaporizer 110 may thereby enable initial or further vaporization of the fuel.

In the specific embodiment of FIGS. 10 and 11, each fuel vaporizer 110 is configured as an air tube 113 for a combustor 114 in the combustor section 116. Note, the combustor 114 may also include at least one air tube 118U and 118D (generally referred to as "118"). The air tubes 118U may be arranged axially forward/upstream of the vaporizers 110. At least one of the air tubes 118D may be arranged in between, for example, each circumferentially neighboring set of the vaporizers 110. Each of the air tubes 113, 118 is connected to and projects out from a wall 120 of the combustor 114 and into a combustion chamber 122 at least partially defined by the combustor wall 120. An air passage 124 of each air tube 113 is configured to receive air and, more particularly, compressed air from a compressor section of the turbine engine (not visible in FIGS. 10 and 11) through a plenum 126. This compressed air is directed through the respective air passage 124 and into the combustion chamber 122. However, before reaching the combustion chamber 122, the air within the respective air passage 124 is mixed with the swirled air-fuel mixture expelled from a respective one of the fuel nozzles 26 through its nozzle orifice 46 to provide a further mixture of compressed air and atomized fuel. By swirling and mixing the fuel with the air within the respective fuel nozzle 26 as described above, the fuel may be more likely to further atomize within the respective air passage 124; e.g., upon entering the air passage 124 and/or upon impinging against the surface 112 (e.g., an inner side wall surface of the air tube 113). By increasing atomization of the fuel, each fuel nozzle 26 may reduce the likelihood of carbon buildup within the plenum 38 and/or within the combustion chamber 122.

Figure 12:
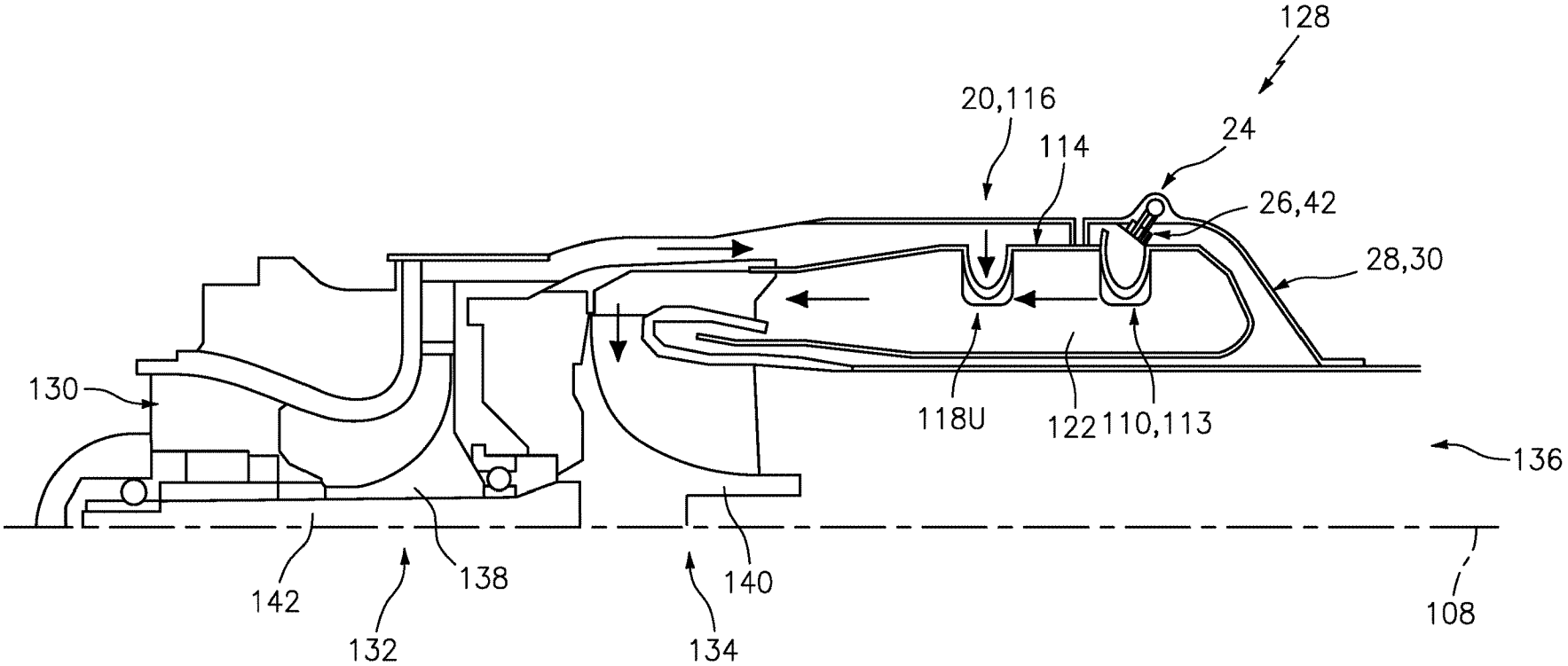
FIG. 12 is a partial side schematic illustration of a turbine engine.

The turbine engine apparatus 20 of the present disclosure may be configured with different types and configurations of turbine engines. FIG. 12 illustrates one such type and configuration of the turbine engine—a one-spool, radial-flow turbojet turbine engine 128 configured for propelling an unmanned aerial vehicle (UAV), a drone or any other aircraft or self-propelled projectile. In the specific embodiment of FIG. 12, the turbine engine 128 includes an upstream inlet 130, a (e.g., radial) compressor section 132, the combustor section 116, a (e.g., radial) turbine section 134 and a downstream exhaust 136 fluidly coupled in series. A compressor rotor 138 in the compressor section 132 is coupled with a turbine rotor 140 in the turbine section 134 by a shaft 142, which rotates about the centerline/rotational axis 108 of the turbine engine 128.

The turbine engine apparatus 20 may be included in various turbine engines other than the one described above. The turbine engine apparatus 20, for example, may be included in a geared turbine engine where a gear train connects one or more shafts to one or more rotors in a fan section, a compressor section and/or any other engine section. Alternatively, the turbine engine apparatus 20 may be included in a turbine engine configured without a gear train. The turbine engine apparatus 20 may be included in a geared or non-geared turbine engine configured with a single spool (e.g., see FIG. 12), with two spools, or with more than two spools. The turbine engine may be configured as a turbofan engine, a turbojet engine, a propfan engine, a pusher fan engine, an industrial turbine engine or any other type of turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure.

Accordingly, the present disclosure is not to be restricted except in light of the attached claims and their equivalents.

What is claimed is:

1. An apparatus for a turbine engine, comprising:

a fuel nozzle comprising an airflow inlet, a nozzle orifice, a fuel passage and a swirler passage;

the fuel passage fluidly coupled with the swirler passage through a first fuel aperture in a wall between the fuel passage and the swirler passage;

the swirler passage extending along a helical trajectory away from the airflow inlet and to the nozzle orifice; and the swirler passage extending along the helical trajectory at least one full revolution around a longitudinal centerline.

2. The apparatus of claim 1, wherein the swirler passage is configured to mix and swirl (a) air received from the airflow inlet with at least (b) fuel received from the first fuel aperture to provide a swirled air-fuel mixture to the nozzle orifice.

3. The apparatus of claim 1, wherein the helical trajectory extends circumferentially about the longitudinal centerline; and the first fuel aperture is configured to direct fuel from the fuel passage into the swirler passage along a canted trajectory that is angularly offset from the longitudinal centerline by an acute angle.

4. The apparatus of claim 1, wherein the fuel passage is further fluidly coupled to the swirler passage through a second fuel aperture in the wall between the fuel passage and the swirler passage.

5. The apparatus of claim 4, wherein the second fuel aperture is circumferentially offset from the first fuel aperture about a centerline of the fuel passage.

6. The apparatus of claim 4, wherein the second fuel aperture is longitudinally offset from the first fuel aperture along as the longitudinal centerline of the fuel passage.

7. The apparatus of claim 1, wherein the fuel nozzle further comprises an inner body, an outer body and a helical shroud;

the inner body is configured with the fuel passage, and comprises the wall between the fuel passage and the swirler passage; and the helical shroud forms the swirler passage between the inner body and the outer body.

8. The apparatus of claim 7, wherein the helical shroud is connected to and extends radially between the inner body and the outer body.

9. The apparatus of claim 1, further comprising a scoop fluidly coupled with and configured to provide air to the airflow inlet.

10. The apparatus of claim 1, further comprising a bleed passage fluidly coupled with and configured to provide air to the airflow inlet.

11. The apparatus of claim 1, further comprising:

a fuel vaporizer;

the fuel nozzle configured to direct a swirled air-fuel mixture out from the nozzle orifice and against the fuel vaporizer.

12. The apparatus of claim 1, further comprising:

a turbine engine case;

at least the fuel nozzle and the turbine engine case formed together in a monolithic body.

13. The apparatus of claim 1, further comprising:

a second fuel nozzle comprising a second airflow inlet, a second nozzle orifice, a second fuel passage and a second swirler passage;

the second fuel passage fluidly coupled to the second swirler passage through a second fuel aperture in a wall between the second fuel passage and the second swirler passage;

the second swirler passage extending along a second helical trajectory away from the second airflow inlet and towards the second nozzle orifice; and a fuel conduit configured to provide fuel to the fuel passage and the second fuel passage.

14. An apparatus for a turbine engine, comprising:

a fuel nozzle comprising an airflow inlet, a nozzle orifice, a fuel passage and a swirler passage;

the fuel passage fluidly coupled with the swirler passage through a first fuel aperture in a wall between the fuel passage and the swirler passage;

the swirler passage extending along a helical trajectory away from the airflow inlet and to the nozzle orifice;

an air tube comprising an air passage; and the fuel nozzle configured to direct a swirled air-fuel mixture out from the nozzle orifice and into the air passage to impinge against an inner sidewall surface of the air tube.

15. The apparatus of claim 14, further comprising:

a combustor wall at least partially forming a combustion chamber;

the air tube connected to the combustor wall and projecting into the combustion chamber.

16. An apparatus for a turbine engine, comprising:

a fuel nozzle comprising a nozzle orifice, an inner body, an outer body and a helical shroud;

the inner body is configured with a fuel passage;

the outer body is configured with an airflow inlet;

the helical shroud extending longitudinally along the inner body, the helical shroud wrapping circumferentially at least one full revolution around the inner body, and the helical shroud forming a swirler passage between the inner body and the outer body;

an upstream portion of the swirler passage fluidly coupled with the airflow inlet and the fuel passage; and a downstream portion of the swirler passage fluidly coupled with the nozzle orifice.

17. An apparatus for a turbine engine, comprising:

a fuel nozzle comprising an airflow inlet, a nozzle orifice, a fuel passage and a swirler passage;

the fuel passage fluidly coupled with the swirler passage through a first fuel aperture and a second fuel aperture, and the first fuel aperture in a wall between the fuel passage and the swirler passage;

the swirler passage comprising a first channel and a second channel, the first channel extending along a first helical trajectory away from the airflow inlet and towards the nozzle orifice, the first fuel aperture located longitudinally along and fluidly coupled with the first channel upstream of an end of the first channel, the second channel extending along a second helical trajectory away from the airflow inlet and towards the nozzle orifice, and the second fuel aperture located longitudinally along and fluidly coupled with the second channel upstream of an end of the second channel; and a helical shroud between and separating the first channel and the second channel, the first fuel aperture longitudinally aligned with the helical shroud along a longitudinal centerline of the fuel passage.

18. The apparatus of claim 17, wherein the first channel extends along the first helical trajectory to the nozzle orifice; and the second channel extends along the second helical trajectory to the nozzle orifice.

* * * * *